United States Patent [19]

Onnigian et al.

[11] Patent Number: 5,068,672

[45] Date of Patent: Nov. 26, 1991

[54] BALANCED ANTENNA FEED SYSTEM

[76] Inventors: Peter K. Onnigian, 1236 40th Ave., Sacramento, Calif. 95827; Philip M. Onnigian, 7449 Fox Hills Dr., Citrus Heights, Calif. 95610

[21] Appl. No.: 318,858

[22] Filed: Mar. 6, 1989

[51] Int. Cl.[5] ..... H01Q 1/50

[52] U.S. Cl. ..... 343/859; 343/821

[58] Field of Search ..... 343/859, 821, , 822, 343/814, 816; 333/26, 32, 33

[56] References Cited

U.S. PATENT DOCUMENTS

| | | | |
|---|---|---|---|
| 1,643,323 | 9/1927 | Stone | 343/844 |
| 1,715,433 | 6/1929 | Stone | 343/853 |
| 2,167,709 | 8/1939 | Cork et al. | 333/26 |
| 2,187,014 | 1/1940 | Buschbeck et al. | 343/859 |
| 2,546,322 | 3/1951 | Smith | 343/821 |
| 2,615,134 | 10/1952 | Carter | 333/26 |
| 2,691,730 | 10/1954 | Lo | 343/803 |
| 2,817,085 | 12/1957 | Schwartz et al. | 343/814 |
| 3,074,064 | 1/1963 | Pickles | 343/821 |
| 3,541,570 | 11/1970 | Onnigian | 343/704 |
| 3,588,905 | 6/1971 | Dunlavy, Jr. | 343/856 |
| 3,594,807 | 7/1971 | Tanner | 343/792.5 |
| 3,618,110 | 11/1971 | Solberg | 343/792.5 |
| 4,254,422 | 3/1981 | Kloepfer et al. | 343/792 |
| 4,433,336 | 2/1984 | Carr | 343/728 |
| 4,479,130 | 10/1984 | Snyder | 343/802 |
| 4,617,571 | 10/1986 | Choquer et al. | 343/744 |
| 4,630,061 | 12/1986 | Hately | 343/749 |

OTHER PUBLICATIONS

Publication: Hy-Gain—1987-88 Issue, p. 9.

Publication: Cushcraft Corp.—Apr., 1988—p. 9.

*Primary Examiner*—Michael C. Wimer

*Assistant Examiner*—Hoanganh Le

*Attorney, Agent, or Firm*—Bernhard Kreten

[57] ABSTRACT

A means for feeding or extracting radio frequency energy from an antenna element which uses coaxial transmission line, without upsetting the antenna elements physical or electrical symmetry, thus providing improved standing wave ratios and near theoretical radiation patterns. Because coaxial cable is inherently unbalanced, double reactance cancellation and resistance transformation are integrally provided by a feed loop shunted across the antenna element improving performance.

15 Claims, 5 Drawing Sheets

BALANCED ANTENNA FEED SYSTEM

FIELD OF THE INVENTION

The following invention relates generally to a method and apparatus for offsetting the undesirable effects of using unbalanced transmission lines to carry electrical signals to a balanced antenna. This novel balanced feed system provides a relatively wide impedance band width and superior radiation patterns.

BACKGROUND OF THE INVENTION

Both transmitting and receiving antennas require transmission lines. There are two basic types of transmission lines: A first type using two or more parallel conductors, and a second type in which one of the conductors is tube-shaped and encloses the other conductor, so called popular coaxial line. With parallel conductors, since the spacing between the two conductors is relatively small, radiation loss can be prevented where the electro-magnetic field from one is balanced everywhere by an equal and opposite field from the other. However, such parallel conductors are susceptible to receiving radiation, altering the carried signal undesirably, and possess other undesirable qualities. Thus, a shielded coaxial cable is preferred and in common usage.

However, with coaxial cable, the current flowing on the inner conductor, although balanced by an equal current flowing in the opposite direction on the inside surface of the outer conductor does not preclude other current flow on the outer skin of the outer conductor. For this reason, coaxial cable is inherently unbalanced.

It is not possible to connect an unbalanced feeder such as a coaxial transmission line to a balanced antenna, and maintain zero potential on the outside of the unbalanced feeder. But it is still current practice to use coaxial line and the very undesirable effects of such currents are tolerated. Some methods to reduce such effects are in use, such as balun (balanced to unbalanced) transformers, but at best they are compromises.

Even when coaxial cable is connected to the physical center of an antenna which is symmetrical about one or more axes, the coaxial cable will induce an imbalance in the operating characteristics of the antenna. Currents flow on the outside of the outer conductor by voltages appearing at the antenna terminal to which it is connected. These currents give rise to unwanted radiation from the transmission line itself, since the field due to them cannot be cancelled by the field due to the current flowing in the inner conductors, which is contained entirely within the outer conductor of the coaxial line and cannot penetrate beyond it.

Stated broadly, that unbalance is caused by the fact that the outside of the outer conductor is not coupled to the antenna in the same way as the inner conductor and the inside of the outer conductor. The overall result is that current will flow on the outside of the outer conductor of the transmission line.

The existence of the unwanted radiation field around the coaxial line will modify the pattern of the antenna. Its input impedance is limited in bandwidth due to the coupling existing between the coaxial line and antenna and will represent a loss of energy by radiation in undesired directions and polarizations. It is also a potential source of TV and broadcast interference and radio frequency feedback problems within the transmitting or receiving facility. Thus it is desired to drive a balanced antenna directly from an unbalanced coaxial transmission line and to prevent unwanted antenna currents flowing back on the outside of the coaxial line.

Various attempts have been made in the past to overcome the inherent effects of using coaxial cable while being mindful of the above problems. A balun is a known technique for balancing the area of conjunction between the feed line and the antenna input. By making this junction balanced, currents of equal amplitude but out of phase will still flow on the outside of the coaxial cable. However being out of phase, since it comes from both halves of the antenna, it cancels itself out and has very little if any measurable effect.

A lumped circuit at the end of the transmission line and antenna junction may be used to provide an unbalanced to balanced connection. However the match depends entirely on the electrical values of the coils and capacitors, and due to their high Q values, the balanced condition bandwidth is very narrow. A similar lumped circuit matching device located at the end of the transmission line remote from the antenna will match the line impedance to the transmitter or receiver, but does nothing for the antenna radiation current flow and radiation on the outer coaxial conductor, line loss or the SWR band width of the antenna.

Another known technique takes advantage of the physical characteristics of coaxial cable and involves placing another tube of appropriate length either over the coaxial cable or parallel to it. The theory involves choking by cancelling the current which travels on the outer surface of the outer coaxial conductor with an opposite current carried on the tube which is either coaxial thereto or parallel thereto. This solution is effective only at one frequency and only between it and the antenna junction, which distance is usually a very small percentage of the total transmission line length.

Still another technique involves the use of coax line configured as a radio frequency choke formed by coiling several turns of the feed line at the point of connection to the antenna. It should be noted that the effectiveness of this type of choke decreases at higher frequencies because of the distributed capacitance among the turns. It suffers from the same lack of total length of transmission line balance as the quarter-wave tube-line choke described above.

In addition, the following prior art citations are listed to show the state of the art further and are submitted in direct response to applicant's acknowledged duty to disclose prior art:

| | | |
|---|---|---|
| 3,074,064 | Pickles | January 15, 1963 |
| 3,541,570 | Onnigian | November 17, 1970 |
| 4,433,336 | Carr | February 21, 1984 |
| 4,479,130 | Snyder | October 23, 1984 |
| 3,618,110 | Solberg | November 2, 1971 |
| 3,594,807 | Tanner | July 20, 1971 |
| 4,630,061 | Hately | December 16, 1986 |
| 4,617,571 | Choquer | October 14, 1986 |
| 4,254,422 | Kloepfer | March 3, 1981 |
| 2,817,085 | Schwartz, et al. | December 17, 1957 |
| 2,691,730 | Lo | October 12, 1954 |
| 1,715,433 | Stone | June 4, 1929 |
| 1,643,323 | Stone | September 27, 1927 |
| Publication | Hy-Gain | May 1987–1988 |
| Publication | Cushcraft Corp | April 1988 |

Pickles teaches the use of a self-supporting dipole antenna with a balun transformer. The coaxial cable passes through one arm of an axial support member which is essentially disposed within a radiator. The coax is then placed on a top surface of the radiator and its center conductor extends to an adjacent radiator fixed thereto on the sheath of a further coax cable, that extends the length of the second radiator. Alternatively, the center conductor can be coupled to a central conductor of a second transmission line and includes material having a high dielectric constant surrounding the central conductor.

SUMMARY OF THE INVENTION

The instant invention is distinguished over the known prior art in a plurality of ways. Where the antenna is fed at its physical center through a coaxial line, its balance is upset because one side of the radiator is connected to the shield (outer conductor) while the other side is connected to the inner conductor. On the side connected to the shield, a current from radiation will flow on the outside of the coaxial line. The fields thus set up cannot be cancelled by the fields of the inner conductor because the fields inside the line cannot escape through the shield afforded by the outer conductor. Hence, these antenna currents flowing on the outside of the line are responsible for undesired radiation and other problems.

Most center-fed antennas are half parasitic and half driving wave devices. By eliminating the imbalance and the associated radiated antenna current on the fed line, the entire center-fed antenna becomes a driving element, which is very useful in Yagi type parasitic arrays, and other antennas.

This invention of feeding power (or extracting it in the receiving case) at the mechanical and electrical center of the antenna element eliminates radiation current flow on the outside of the coaxial feed cable. This is true because any current on that coaxial cable is nulled out by equal amplitude and opposite phase contribution from the radiator.

The physical and electrical size of the double gamma arms in the instant invention (loop length and width) together with the capacitance used to cancel the natural inductive reactance of the arms, provides an electrical matching system between the antenna and its coaxial transmission line impedance.

Alternatively stated, a center-fed antenna includes an axis of symmetry, and equidistant from this axis a pair of support arms are operatively coupled. These arms in turn communicate with a pair of short gamma arms which are inwardly directed towards the axis of symmetry and spaced from the axis by an electrically small gap. The coaxial cable is fed from its usual center attachment point either inside or along side, communicating with both one support arm and a gamma arm. An area where one gamma arm ends, defining one edge of a gap between it and its facing gamma arm is the area of attachment for the sheath of the coaxial line, if it is otherwise insulated to that point. The central conductor extends through the gap to a capacitor, which is electrically connected between this inner conductor and the opposite gamma arm.

Alternately, a capacitor may be formed as illustrated in FIG. 1, which is placed inside the gamma arm. It must be made clear here the capacitor may be placed either inside the gamma arm, or outside it, and in either event connected between the inner conductor termination and the opposition gamma arm.

As previously mentioned, although matching devices at the end of the transmission line remote from the antenna element can be used to match line impedance, it does nothing for line loss or the SWR band width of the antenna as does the instant invention. By cancelling reactance and transforming resistance of the antenna to the line impedance, maximum power transfer is attained. Thus, not only is a balanced feed system obtained, but also a simple method of impedance matching by reactance cancellation is disclosed to correct for impedance changes with frequency. The net results provide good impedance band width and radiation patterns.

In essence, the feed matching system disclosed herein presents a very high SWR to harmonics of the design frequency, so that the antenna also acts as an RF filter. It rejects both odd and even harmonics of the fundamental fed to it.

While the foregoing was intended to be specifically directed to various forms of half wave dipole antennas, the instant invention also has particular utility with respect to certain circularly polarized antennas, such as that which was described in U.S. Pat. No. 3,541,570, issued to the instant inventor. That invention described a support tube-arm which carries at each end a V-shaped element, which collectively forms a substantially square-shaped configuration with the support tube serving as a diagonal. The four arms serve as radiators of one complete antenna. By twisting the two sets of dipoles 45 degrees with respect of each other, circularly polarized radiation is produced. This antenna, although very popular commercially, suffers from undesirable radiation patterns caused by uncontrolled currents flowing on its support tube-arm, which are due primarily to the unbalanced method of feeding the four arms. As may be seen in FIG. 3, two arms are fed from the "wishbone," while the other two are parasitics.

By using the configurations of gamma arms discussed here and above but oriented such that one support arm and gamma arm extends from each arm of the V-shaped array, thereby uniting two of the elements defining one V-shaped pair, a balanced feed system is provided this type of radiating element. In addition, unlike the earlier device, all four arms are fed power. Therefore there are no parasitic arms and no arm is fed from the other.

In its essence, the instant invention provides an instrumentality for transferring radio frequency to an antenna element using coaxial transmission line, without upsetting the antenna element's physical or electrical symmetry. This provides radiation patterns which would not otherwise be possible. Even though coaxial transmission line is inherently unbalanced and produces unwanted antenna radiation along the outer skin of the outer conductor of the coaxial cable, the instant invention provides a method for connecting an unbalanced coaxial transmission line to a balanced antenna without upsetting the antenna element's electrical balance. The net result of the configuration to be discussed infra thereby provides greater SWR band width, a symmetrical radiation pattern and, in directional antennas, much greater symmetry of the main lobe and greater reduction of side lobes, as well as back lobes than is presently possible.

OBJECTS OF THE INVENTION

Accordingly, it is a primary object of the present invention to provide a new and useful antenna system.

A further object of the present invention is to provide a device as characterized above which cancels unwanted reactance inherent in the balanced gamma arms and transforms the radiation resistance of the antenna to match that of the transmission cable.

It is a further object of the present invention to provide an antenna which will remain stable over a wider frequency band width by providing a balanced feed system.

A further object of the present invention is to provide the device as characterized above with wide impedance band widths. It is possible to provide as much as 20 percent impedance band width at SWR ratios under 2:1.

It is a further object of the present invention to provide a method of cancelling inherent antenna reactance over a relatively large range of frequencies through the use of this balanced feed loop system.

It is a further object of the present invention to provide a double tuned antenna matching means, first by the fundamental resonance of the driven element, and secondly by the balanced feed method, thereby improving the SWR bandwidth.

A further object of the present invention is to provide maximum power transfer by matching the antenna to the characteristic impedance of its feed line.

A further object of the present invention is to minimize transmission line loss.

A further object of the present invention is to provide not only a balanced feed system, but also a simple method of impedance matching to correct for impedance changes with frequency in the antenna.

A further object of the present invention is to minimize unwanted random polarizations.

A further object of the present invention is to provide a balanced method of feeding: a matching system which feeds the dipole not only at its physical center, but also at its electrical center, so that the radiation peak is broadside to the array, thereby eliminating radiation pattern squint.

A further object of the present invention is to provide a matching system which operates over a rather broad range of frequencies so that the impedance band width is greater than the useful pattern band width of comparable antennas. Thus, the impedance band width is not the limiting parameter of the usefulness of the antenna.

A further object of the present invention is to provide a feed system which is adjustable so that any reactance it may encounter in the match can be cancelled out. The matching can be over a wide range capable of matching not only a thin dipole radiator with high radiation resistance but one with rather low resistance.

A further object of the present invention is to provide a matching feed system as characterized above which is capable of being used on various antenna configurations currently in existence.

A further object of the present invention is to provide a matching system which can be used with microstrip and path antennas.

A further object of the present invention is to provide a feed matching system which presents a very high SWR to harmonics of the fundamental design frequency, so that the antenna acts as an RF filter.

Viewed from one vantage point, an antenna system is provided which includes an antenna element, a coaxial cable for carrying an electrical signal and balancing means coupling the antenna element to the coaxial cable whereby electrical imbalance inherent in coaxial cable is neutralized.

Viewed from a second vantage point, it is an object of the present invention to provide an antenna system having an antenna element with both a physical and electrical center, a coaxial cable for carrying an electrical signal and an instrumentality for coalescing the antenna element's physical and electrical centers interposed between the antenna element and the coaxial cable whereby the coaxial cable connects to the antenna element not only at its physical center but also its electrical center.

Viewed from a third vantage point, it is an object of the present invention to provide a method for tuning an antenna system so that its impedance band width is greater than its useful pattern band width, the steps including coupling an outer conductor of a coaxial cable to the physical center of an antenna element and adjusting the length of the center inner conductor of the coaxial cable to cause the center conductor to exhibit capacitance which offsets antenna feed system reactive imbalance.

Viewed from a fourth vantage point, it is an object of the present invention to provide a method of feeding a balanced antenna system so that the inductive reactance caused by such feeding method is neutralized through the use of a suitable capacitive reactance placed at the balanced feed point.

These and other objects will be made manifest when considering the ensuing text taken in conjunction with the drawing figures.

BRIEF DESCRIPTION OF THE DRAWING FIGURES

BRIEF DESCRIPTION OF THE PREFERRED EMBODIMENTS

Figure 1:
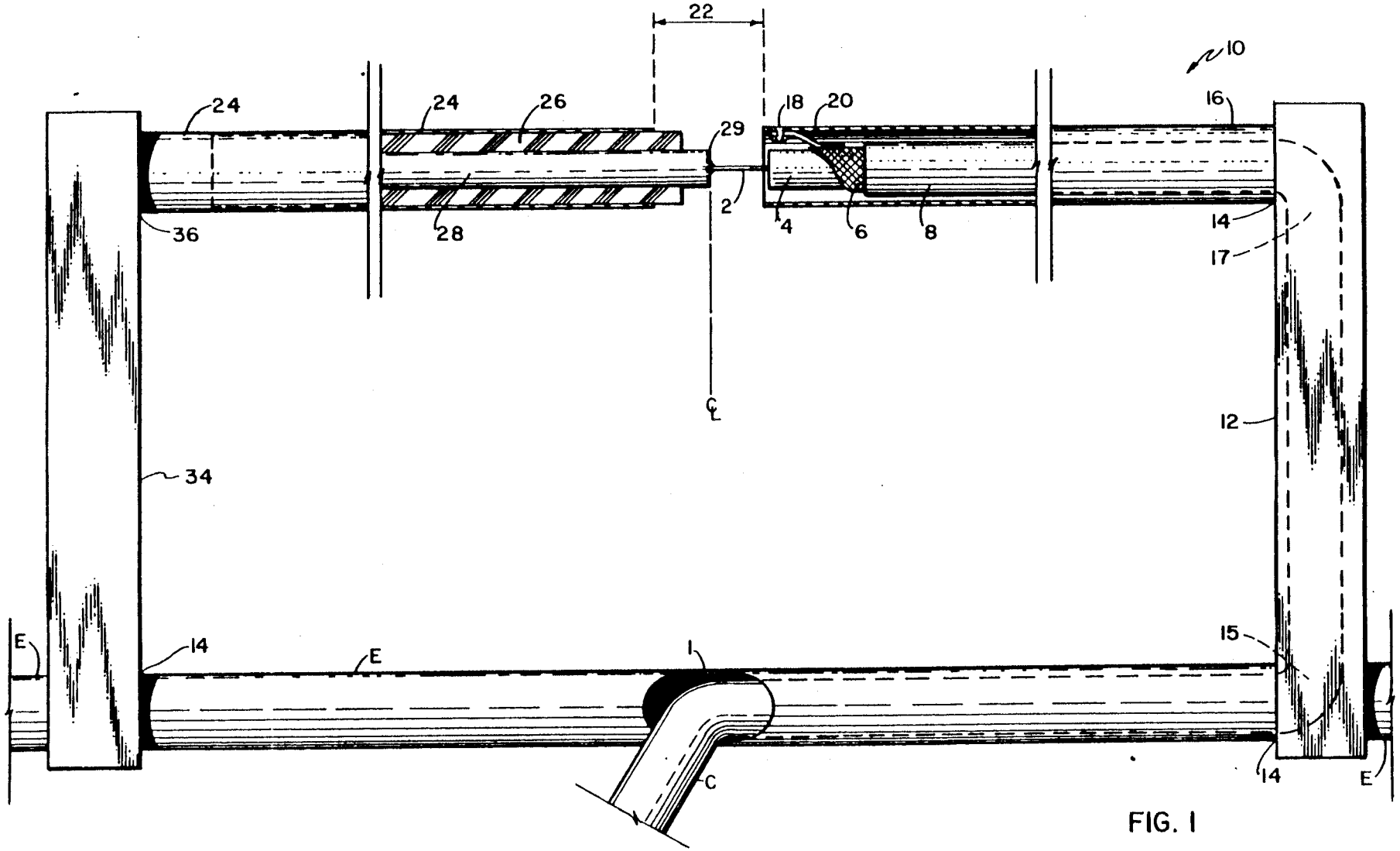
FIG. 1 shows the apparatus according to one form of the invention, partially in section.

Referring to the drawings now, where in like reference numerals refer to like parts throughout the various drawing Figures, reference numeral 10 is directed to the balanced gamma feed and matching device according to the present invention.

Essentially, the double gamma feed system is a method of putting an unbalanced coaxial cable across an antenna's balanced feed point without upsetting that balance electrically or mechanically. In the present invention, a feed loop 10 attaches to an antenna element E at its electrical and physical center, and allows the coaxial cable C to appear at the neutral point of the loop, at gap 22, without upsetting the balance. Cable C enters at the mechanical center at point 1 and travels up to the gap 22, as shown in FIG. 1. With mechanically solid antenna elements, the cable C can be strapped to the outside of the loop 10 instead of passing through the inside.

The loop 10 includes a pair of support arms 12, 34 which extend from element E. A pair of gamma arms 16, 24 are supported, one on each support arm and face each other inwardly, leaving the gap 22 therebetween.

The length of gamma arms 16 and 24 determines the amount of antenna radiation resistance encompassed by the loop 10 and appearing at the gap 22. The width of the loop defined by the length of support arms 12 and 34 varies the impedance matching characteristics of the loop. The ratio of tube diameters or strip widths of the gamma arms and the antenna element E are not so important, as in the conventional unbalanced gamma feed system, which has been around for decades. The physical diameter ratio between the gamma arms 16,24 (be they round or strip) and the driven element, E, in addition to the gamma loop length and width, determines the electrical matching network between the coaxial cable impedance and that appearing at gap 22. Typically, the feed loop 10 is approximately 0.04–0.1 wavelength long.

In addition to radiation resistance appearing at gap 22, there is also inductive reactance caused by both the support arms 12 and 34 and the gamma arms 16 and 24. This reactance is cancelled by a capacitor of suitable value in series with the center conductor 2 of the coaxial feed line C at the gap 22 and gamma arm 24. Thus the coaxial cable is connected at gap 22, through a capacitor to the gamma arm 24. This capacitor may be internal in the gamma arm 24, or may be external. The preferred internal embodiment is shown in FIG. 1.

More specifically, the antenna element E can be of any known, commercially available dipole. The element can be a single element, or a plurality of elements disposed in an array. either driven or parasitic, which may be reflective or direction, such as a Yagi.

The element E includes an access port 1 to allow the through passage of the coaxial cable C. The cable is routed through one arm of the element E and exits the element through a bore 15 that allows passage through a support arm 12, which itself is fixed on the element E by means of a bore 14 which overlies the element and fixes the support arm 12 thereon. The cable is routed upwardly through a second opening 17 and advances back to the center line of the antenna and is contained within a gamma feed arm 16. Gamma arm 16 is fixed within a bore 14 complementarily formed within an upper portion of the support arm 12 and is cantilevered towards the center line CL of the antenna, freestanding.

Coaxial cable includes a central conductor 2, a dielectric insulator 4 which surrounds the center conductor, an outer conductor 6 formed as a braided mesh or tube which overlies the dielectric insulator 4 and an outer plastic 8. The outer plastic 8 in gamma arm 16 acts only as a mechanical support. As the Cable C approaches the free end of the first gamma feed arm 16, a portion of the outer plastic sheath 8 is removed, exposing the outer conductor 6. The conductor 6 is fixed to the free end of the first gamma feed arm 16 near an end thereof, by means of a tap bolt 18, which fastens to the free end through a connection 20.

The first support arm 12 has a counterpart 34. This second support arm 34 is disposed on an opposite side of the antenna element's center line CL equidistant form the center line so that the axis of symmetry reveals two support arms equispaced therefrom. The second support arm 34 attaches to the antenna element E through a bore 14, and has an upwardly extending end provided with a bore 36 through which is fixed a second gamma arm metal tube 24 which symmetrically complements first gamma arm 16. The tube 24 houses a plastic insulating tube 26 there within concentrically. Additionally, the plastic tube houses there within a metal tube 28 concentrically. The central conductor 2 is exposed by removal of the plastic dielectric insulator 4 and a certain length of the center conductor 2 passes within the copper tube 28 and is mechanically and electrically connected to tube 28, thereby forming a capacitor whose reactance cancels the inductive reactance otherwise present. FIG. 1 reflects a plug 29 defining the mechanical connection. The plug and conductor are preferably brazed together and the plug 29 is present within the tube 28.

Note that a gap 22 exists between the two gamma shorting arms 16 and 24. This gap 22 is bisected by the center line axis of symmetry. Note also that the plastic tube 26 and the metal tube 28 are capable of axial translation along the length of the metal tube 24. This allows the metal tube 28 to be lengthened or shortened, providing the proper value of capacitance during initial tuning adjustment.

Figure 2:
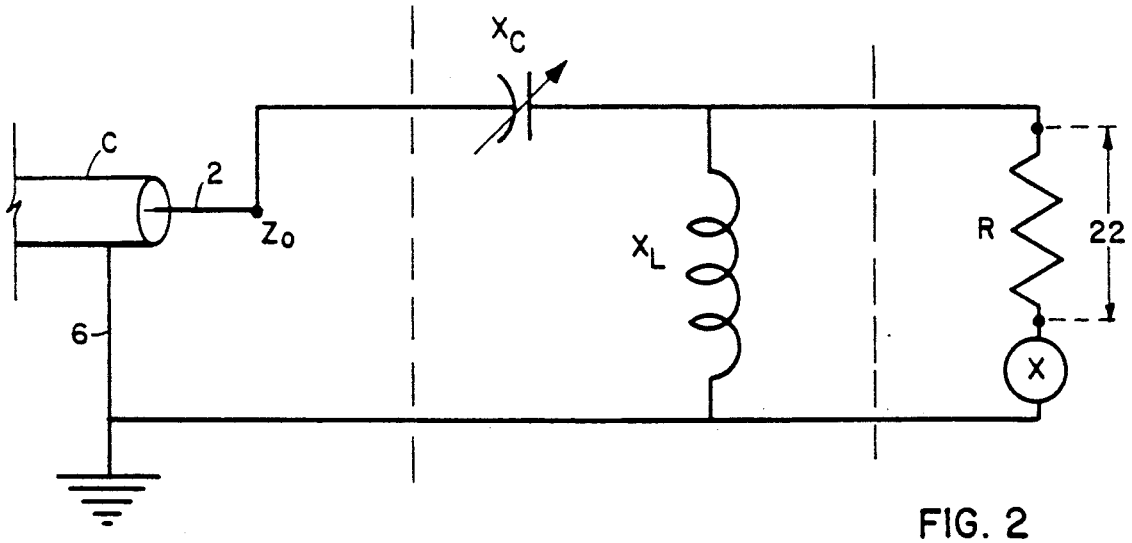
FIG. 2 is a schematic diagram of that which is shown in FIG. 1.

Certain design parameters with reference to FIG. 1 are depicted in the schematic of FIG. 2. This Figure reflects certain reactance cancellation and resistance transformation in an L type electrical matching network which has the property of cancelling reactance and transforming resistance. The matching network of FIG. 2 consists of antenna radiation impedance which contains both resistance and reactance. The antenna impedance X is transformed to the feed line resistance $Z_0$ by the inductance in gamma arms and the capacitive resistance contained in the gamma capacitor $X_C$. Note that the antenna resistance R appears between the gap 22 formed by the open ends of the first and second gamma arms 16 and 24. R is elevated above the ground neutral plane by the reactance X which is formed by one-half of the feed loop containing the coaxial cable plus the other half of the loop without the cable. It should be clear that the coaxial cable C need not be internal the feed loop 10. It may be external to the connecting gamma arms as long as the cable is still contained within its outer sheath conductor 6 which in turn is connected to the shorting arm as discussed supra.

The gamma capacitor $X_C$ in FIG. 2 is shown as the series reactance and the shunt reactance $X_L$ defines the gamma arms corresponding to arms 16 and 24. The plastic tube 26 and its relationship with respect to both the metal tube 28 and the gamma arm 24 define the gamma capacitor $X_C$.

The ratio of the series reactance $X_C$ to the series resistance $R_C$ is defined as the network Q. The lower the Q, the wider the bandwidth for a given value of SWR. The values of the variables in FIG. 2 can be determined empirically.

Figure 3:
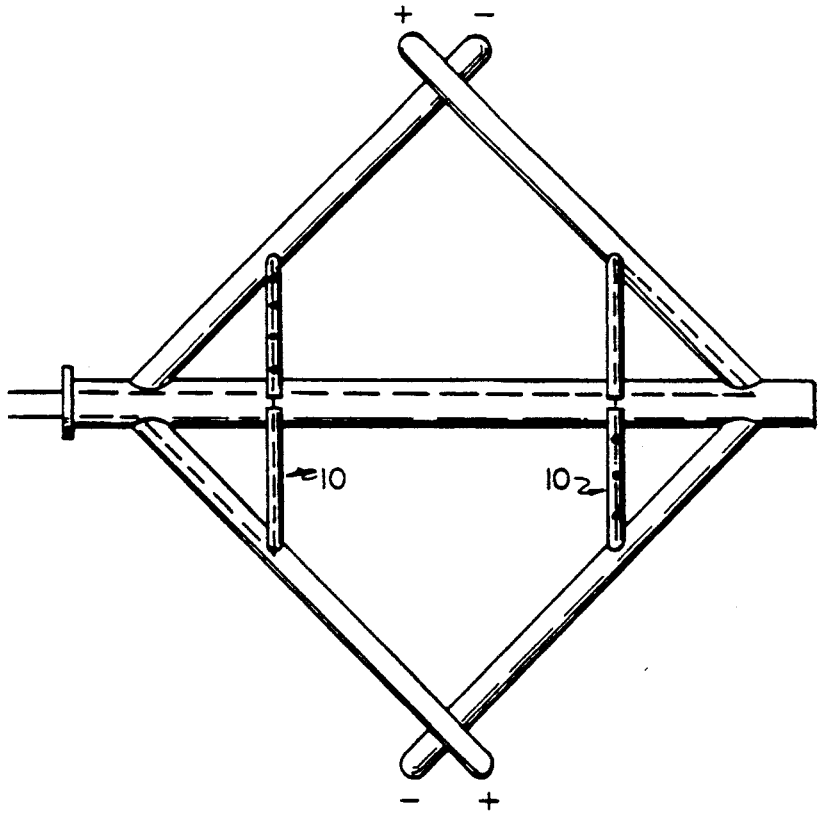
FIG. 3 shows a modification of the inventor's circularly polarized antenna using the FIG. 1 and FIG. 2 teachings.
Figure 5:
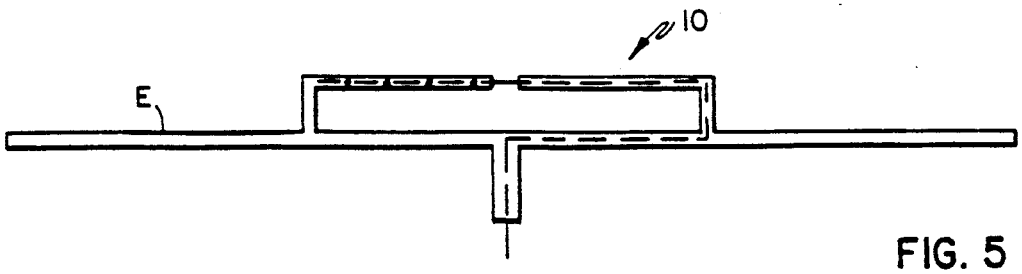
FIG. 5 illustrates a dipole system.

With respect to FIG. 3, a modification of the circularly polarized antenna, described in U.S. Pat. No. 3,541,570 granted to applicant, is depicted as in plan view. Whereas the feed method associated with that patent was physically and electrically unbalanced, the provision of the two feed loops 10 shown in FIG. 3 allows all four dipoles to be fed power and become electrically identical. Thus, the double dipole supporting arm is physically and electrically isolated from the dipole electrical feed system. In view of the foregoing, it should be apparent that the coaxial cable enters the feed loop and attaches thereto at an RF neutral location. This improved method of supplying power to a half wave dipole antenna eliminates RF feed current flow on the antenna's associated supporting structure, thus eliminating radiation pattern distortion caused by such currents.

If the coaxial cable is led away perpendicularly from the center of the element, any current flow on the outside of the coaxial transmission line as a result of antenna radiation will be insignificant, since such induced currents will be equal in amplitude, but opposite in phase. Thus, there is a smooth transition from an unbalanced coaxial transmission line to the balanced feed terminals where the outer conductor 6 connects with gamma arm 16 and where the inner conductor 2 extends within the second gamma arm 24, as depicted in FIG. 1.

Figure 4:
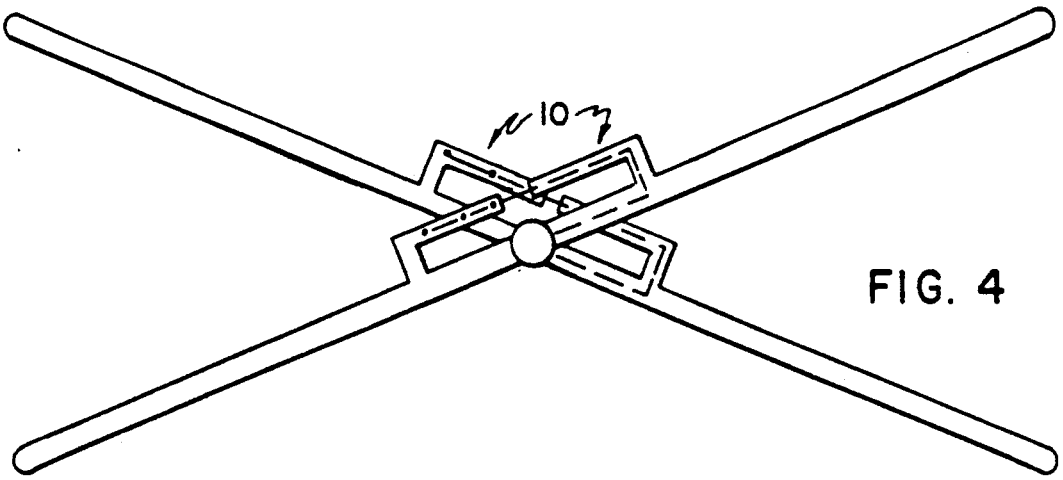
FIG. 4 illustrates an end view of FIG. 3.
Figure 6:
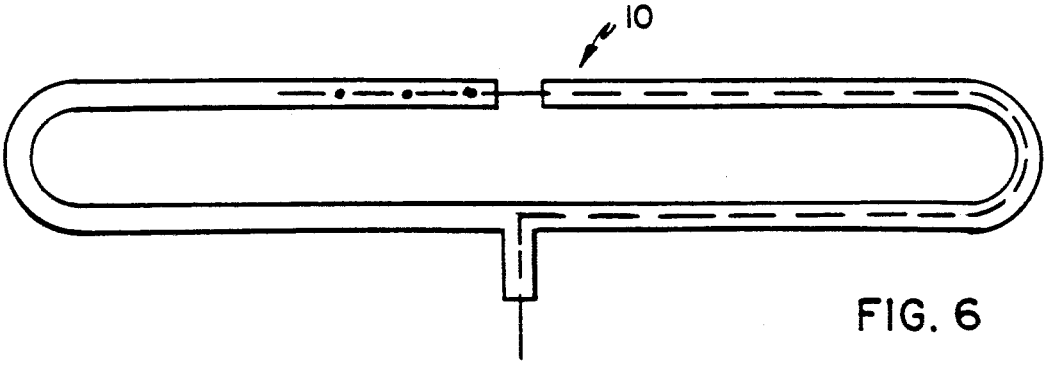
FIG. 6 illustrates a folded dipole system.
Figure 7:
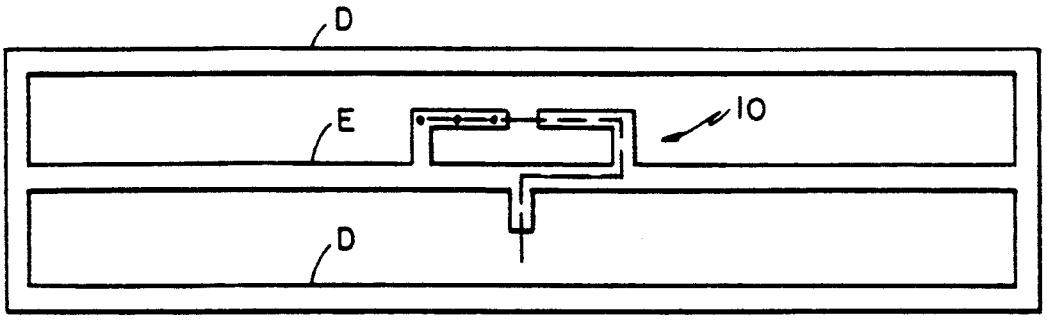
FIG. 7 illustrates a folded dipole with multiple conductors D.
Figure 8:
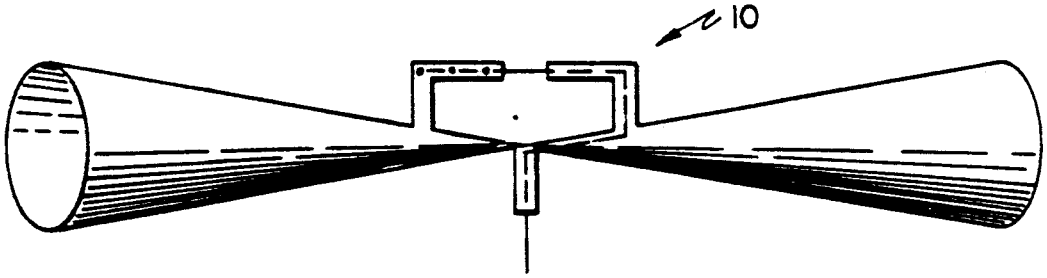
FIG. 8 illustrates a biconal horn embodiment.
Figure 9A:
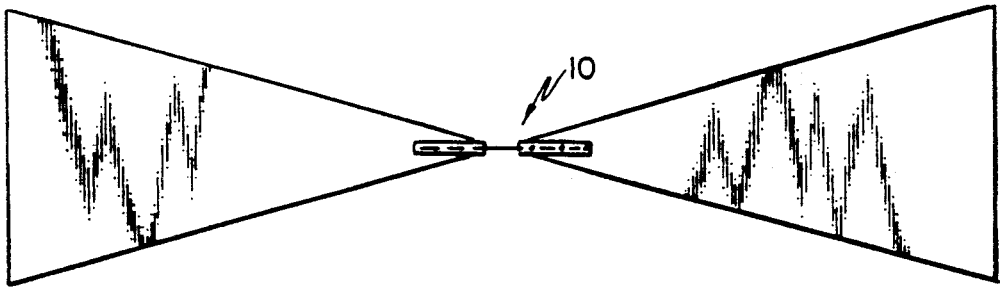
FIG. 9A illustrates a triangular dipole system, plan view.
Figure 9B:
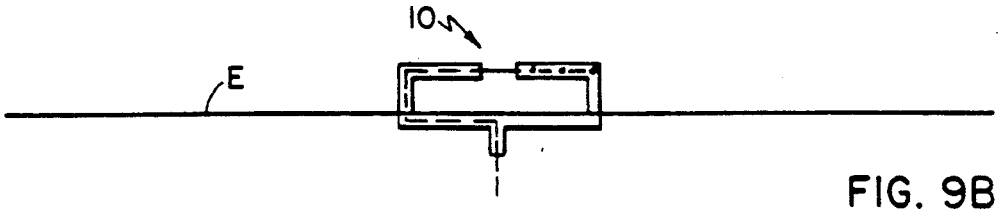
FIG. 9B illustrates the 9A view in elevation.
Figure 10:
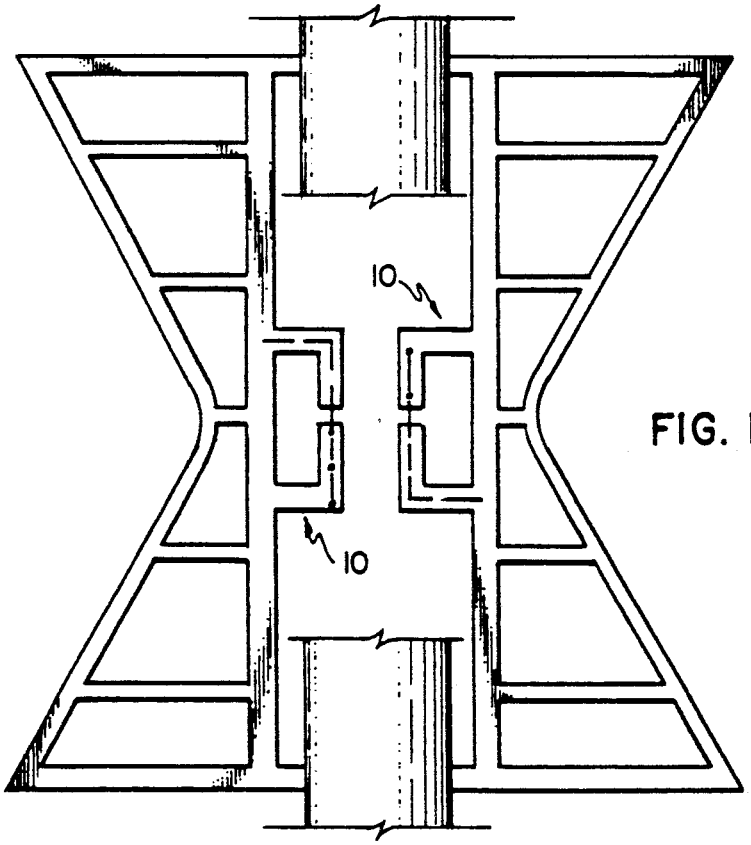
FIG. 10 illustrates a batwing or "turnstile" radiator.
Figure 13:
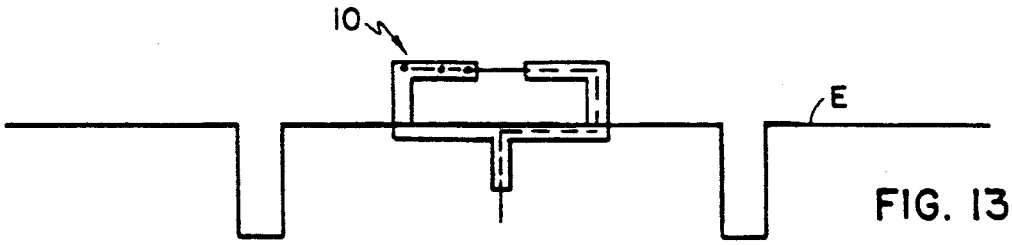
FIG. 13 illustrates a "Franklin" type antenna system.
Figure 11:
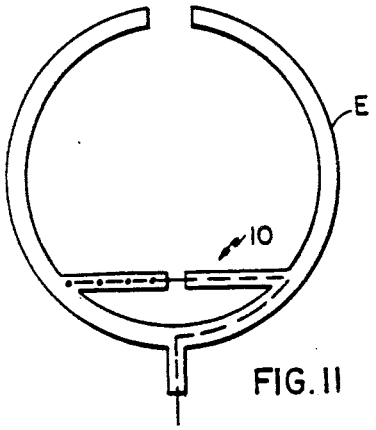
FIG. 11 illustrates a "ring" type antenna system.
Figure 16:
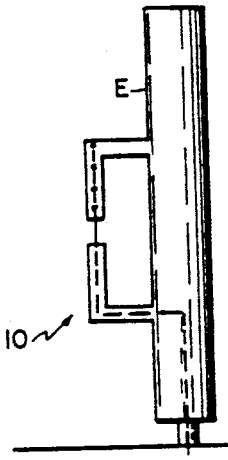
FIG. 16 illustrates a vertical end fed antenna.
Figure 12:
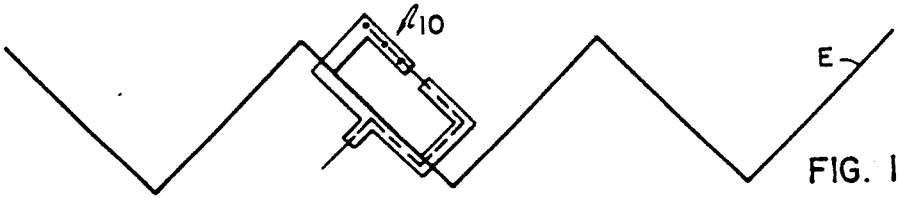
FIG. 12 illustrates a "zig-zag" antenna embodiment.
Figure 15:
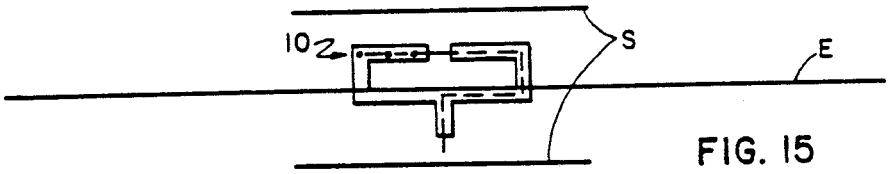
FIG. 15 illustrates a sleeve S dipole system.
Figure 14:
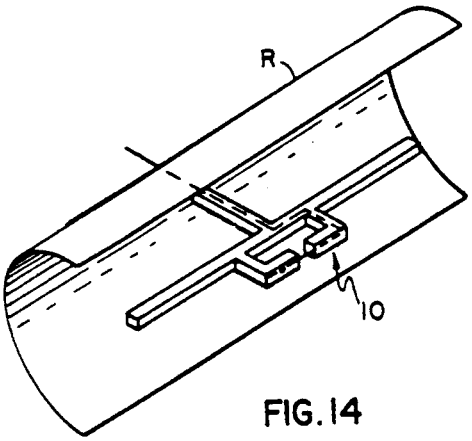
FIG. 14 illustrates a reflector R antenna which may be parabolic (as shown), L shaped, flat, etc.
Figure 17:
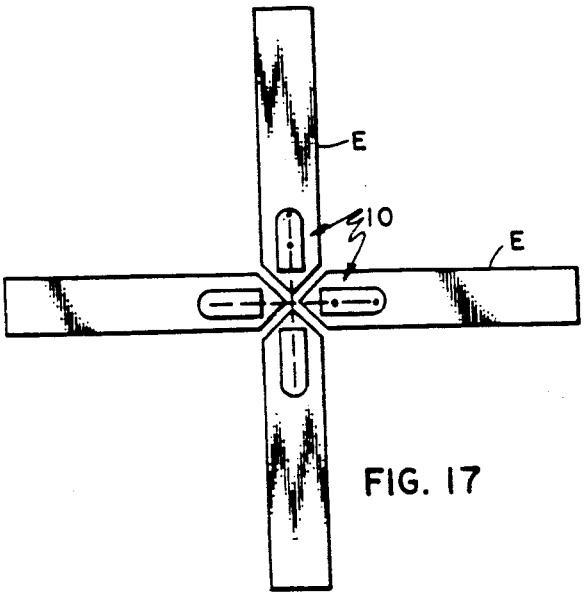
FIG. 17 illustrates a plan view of a crossed dipole system.

With respect to FIG. 4, the antenna of FIG. 3 is shown from an end view orientation. It will be noted that the two sets of dipole arms are orientated 45 degrees with respect to each other and 22.5 degrees from a horizontal plane, to provide circular polarization. It is also seen that the two double gamma feed arms are equally placed with a physically and electrically balanced condition existing around the antenna's central support arm.

FIGS. 5–17 illustrate further, uses of the feed loop 10 in other known antenna configurations, as mentioned above. In each, the coaxial cable is indicated with a series of dashes (---) while the capacitor is depicted as dashes with interposed dots (-.-.-.).

Upon initialization, the coaxial cable is looped as described supra and the relationship of the plastic tube and metal tube length are arranged for matching the system impedance and assuring maximum power transfer. Once the relationship of the tubes and the capacity are established, they are fixed in position within the second gamma arm.

Moreover, having thus described the invention is should be apparent that numerous structural modifications and adaptations may be resorted to without departing from the scope and fair meaning of the instant invention as described here and above and as set forth here and below by the claims.

We claim:

1. A dipole antenna having an integral balun and impedance matching structure comprising two axially spaced conductors defining a gap therebetween, an antenna conductor, means joining said spaced conductors to said antenna conductor, said axially spaced conductors, said joining means and said antenna conductor forming a folded loop having an overall electrical length which is a small fraction of the operating wavelength, a coaxial cable secured to a portion of said antenna conductor and extending to an end location of one of said spaced conductors at said gap, a dielectrically insulated conductor secured to the other of said spaced conductors to form a capacitor therewith, the center conductor of said coaxial cable being connected to said dielectrically insulated conductor across said gap; and an extended antenna radiator extending outwardly from end portions of said antenna conductor to form said dipole antenna.

2. The combination of claim 1 wherein said other spaced conductor is of tubular construction and said dielectrically insulated conductor is coaxially mounted within said other spaced tubular conductor.

3. The combination of claim 2 wherein said dielectrically insulated conductor is slideably mounted within said other spaced tubular conductor to adjust the capacitance thereof.

4. The combination of claim 2 wherein one spaced conductor is of tubular construction, said coaxial cable extending within said one spaced conductor to said gap and electrically connected to said dielectrically insulated conductor.

5. The combination of claim 4 wherein the other conductive shield of said coaxial cable is connected to said one spaced conductor at said gap.

6. The combination of claim 4 wherein said joint means comprises a pair of support arms connecting said axially spaced conductors and said antenna conductor to form a rectangular folded loop.

7. The combination of claim 6 wherein one of said support arms is of hollow construction and connects with said one spaced tubular conductor, said coaxial cable within said one spaced tubular conductor extending into the hollow of said one support arm.

8. The combination of claim 7 wherein a portion of said antenna conductor is tubular in shape and connects with said one hollow support arm, said coaxial cable within said one hollow support arm extending into the tubular portion of said antenna conductor.

9. The combination of claim 8 wherein said antenna conductor is provided with an access port at a medial portion thereof, said coaxial cable within said tubular portion of said antenna conductor extending through said access port.

10. The combination of claim 1 wherein said antenna conductor is in a series circuit with both said folded loop and said dipole antenna.

11. The combination of claim 1 wherein said folded loop and said extended antenna radiator lie in a substantially common plane.

12. The combination of claim 1 wherein said folded loop and said extended antenna radiator lie in different planes.

13. The combination of claim 12 wherein said folded loop and said extended antenna radiator form a V-dipole.

14. The combination of claim 13 including a second folded loop and V-dipole mounted in opposed relation to said first V-dipole and twisted 45 degrees thereto to radiate circularly polarized energy.

15. An antenna comprising two axially spaced tubular elements defining a gap therebetween, a pair of support arms each having first and second ends, an antenna element, said first end of each support arm being serially connected to an end portion of said tubular elements, said second end of each support arm being connected to said antenna element whereby said tubular elements, said support arms and said antenna element form a folded loop having a symmetrical axis and an overall electrical length which is a small fraction of a wavelength, an access port in said antenna element located on the symmetrical axis of said folded loop, a coaxial cable passing within said access port and extending through the interior of a portion of said antenna element, the interior of one of said support arms, and one of said tubular elements and terminating at said gap, said gap being located on said symmetrical axis, a conductor mounted within the interior of the other of said tubular elements to form a capacitor therewith, the center conductor of said coaxial cable being connected to said conductor across said gap; and an extended antenna radiator connected to the outer end portions of said antenna element.

* * * * *